US007464855B2

(12) United States Patent
Glasgow

(10) Patent No.: US 7,464,855 B2
(45) Date of Patent: Dec. 16, 2008

(54) COMBO BOX AND ASSOCIATED BLANK

(75) Inventor: Timothy C Glasgow, Lakeland, FL (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 11/618,354

(22) Filed: Dec. 29, 2006

(65) Prior Publication Data

US 2008/0156859 A1 Jul. 3, 2008

(51) Int. Cl.
*B65D 25/06* (2006.01)
*B65D 5/4805* (2006.01)

(52) U.S. Cl. ..... 229/120.13; 229/120.17; 229/120.18; 229/178; 229/906

(58) Field of Classification Search ..... 229/120.13, 229/120.17, 120.18, 172, 173, 178, 902, 229/906
See application file for complete search history.

(56) References Cited

U.S. PATENT DOCUMENTS 1,466,344 A * 8/1923 Sardou ..... 229/120.17
3,297,228 A * 1/1967 Contratto ..... 229/120.13
4,089,458 A * 5/1978 Meyers et al. ..... 229/120.17
4,237,171 A * 12/1980 Laage et al. ..... 229/152
5,335,845 A * 8/1994 Liu ..... 229/120.17
5,718,370 A * 2/1998 Lafferty et al. ..... 229/120.18
5,890,648 A * 4/1999 Cai ..... 229/902
5,909,840 A * 6/1999 Schultheiss ..... 229/120.13
6,588,652 B2 * 7/2003 Cai ..... 229/120.18
2004/0124236 A1 * 7/2004 Howard ..... 229/178

* cited by examiner

*Primary Examiner*—Gary E Elkins

(57) ABSTRACT

The present invention is directed to a multi-product container and container blank. In accordance with the present invention, a single sheet of foldable material is cut and scored to define a container blank. The blank includes a variety of panels, flaps and tabs, that when erected, form a container that includes two container areas. The two container areas may be the same size, or they may be of different size. The container includes a top panel assembly that may be locked to close the container. In once aspect of this invention, the container is useful for application such as the pizza market where the pizza is placed in one container area and other items are placed in the second container area.

5 Claims, 4 Drawing Sheets

COMBO BOX AND ASSOCIATED BLANK

FIELD OF THE INVENTION

This invention relates generally to containers and, more specifically, to multi-product containers and container blanks.

BRIEF DESCRIPTION OF THE DRAWINGS

Various embodiments of the present invention are described in detail below with reference to the following drawings.

DETAILED DESCRIPTION OF THE INVENTION

The present invention will now be described with reference to the accompanying drawings. The present invention is directed to a multi-product type container that utilizes a fold over divider panel with and a fully coving top panel. One suitable embodiment of a multi-product type container 56 constructed in accordance with aspects of the present invention is illustrated in FIGS. 1-8. Specific details of the blank 20 and resulting container 56 are described with more particularity below.

Figure 1:
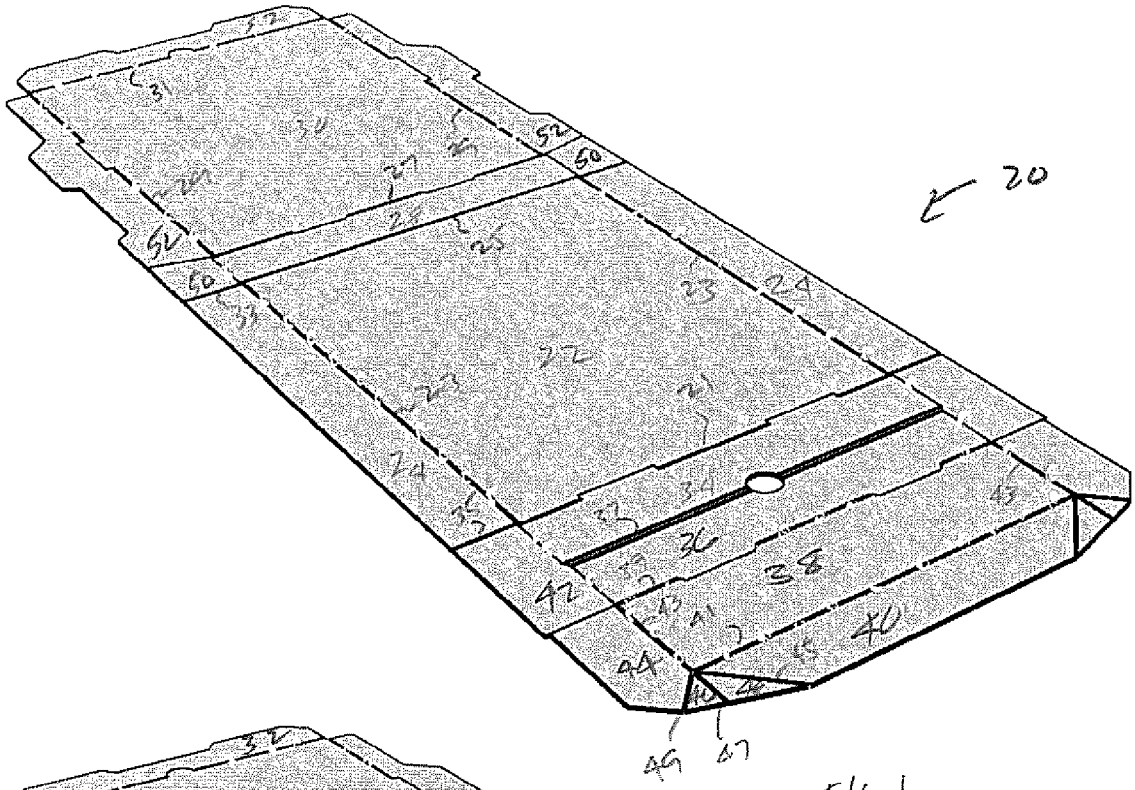
FIG. 1 is a perspective view of a single piece container blank formed in accordance with the present invention.
Figure 2:
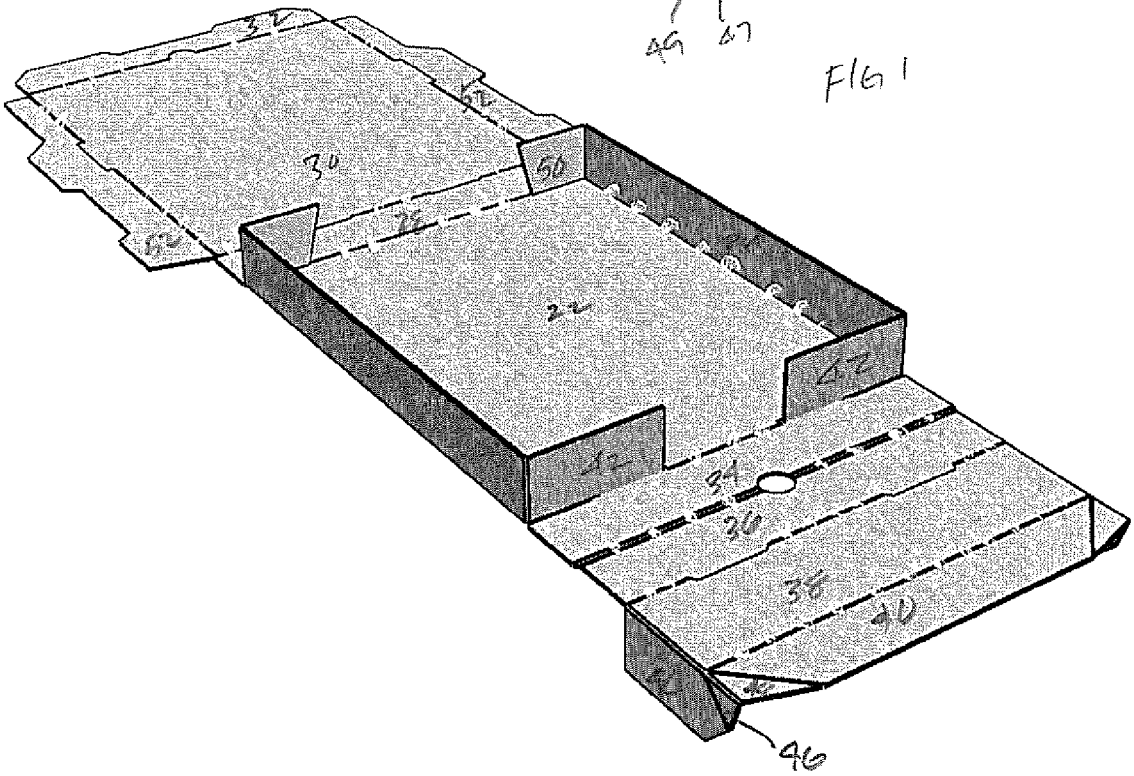
FIG. 2 is a perspective view of a partially assembled container according to the present invention.
Figure 3:
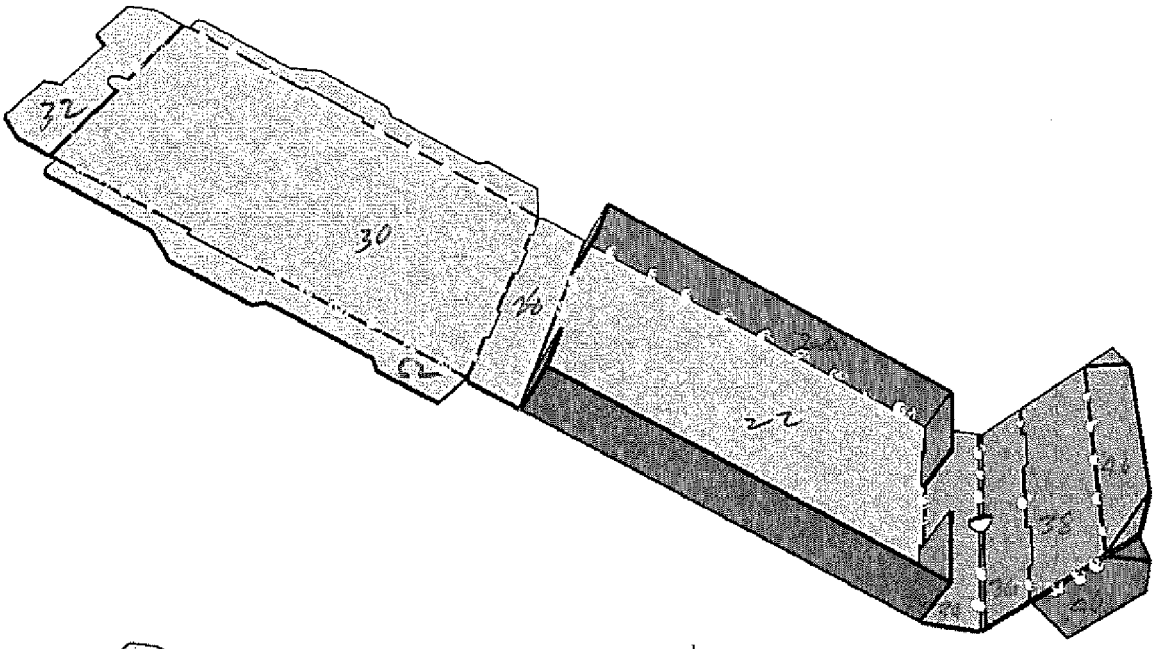
FIG. 3 is another perspective view of a partially assembled container according to the present invention.
Figure 4:
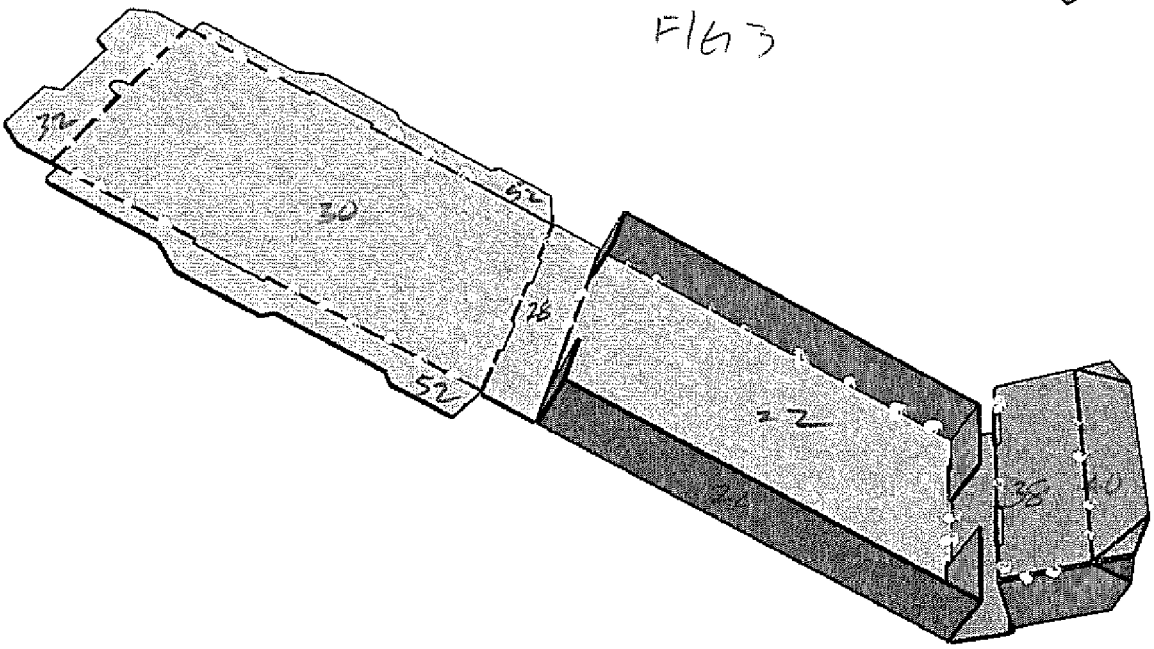
FIG. 4 is yet another perspective view of a partially assembled container according to the present invention.
Figure 5:
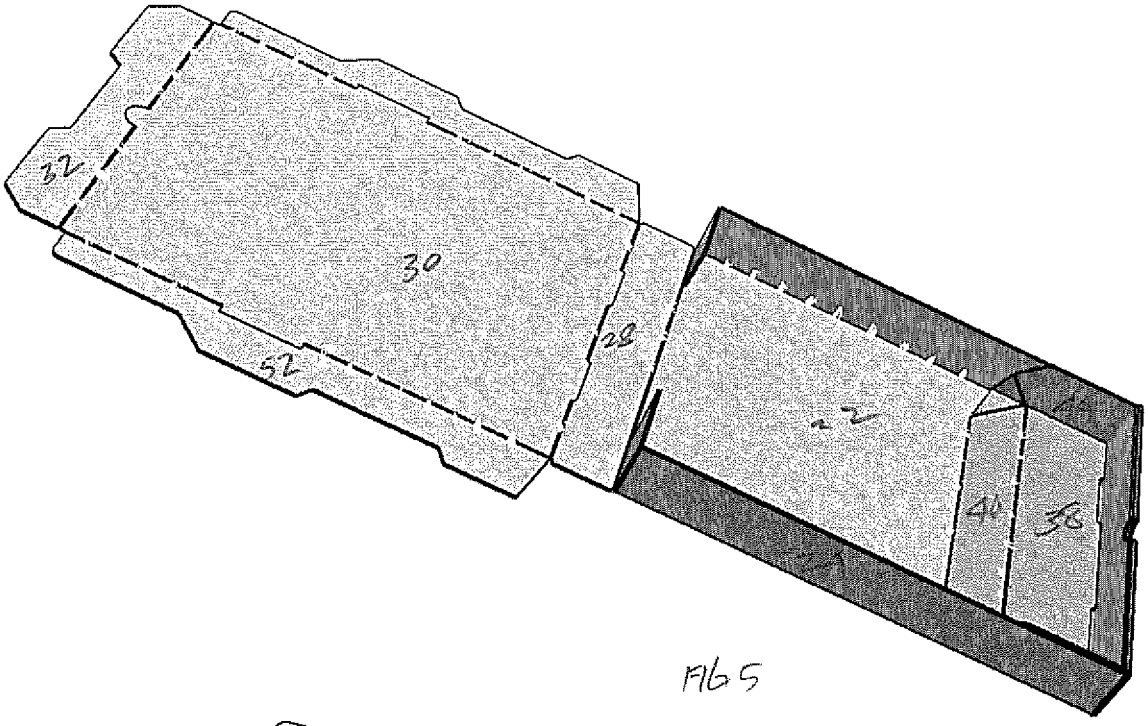
FIG. 5 is still another perspective view of a partially assembled container according to the present invention.
Figure 6:
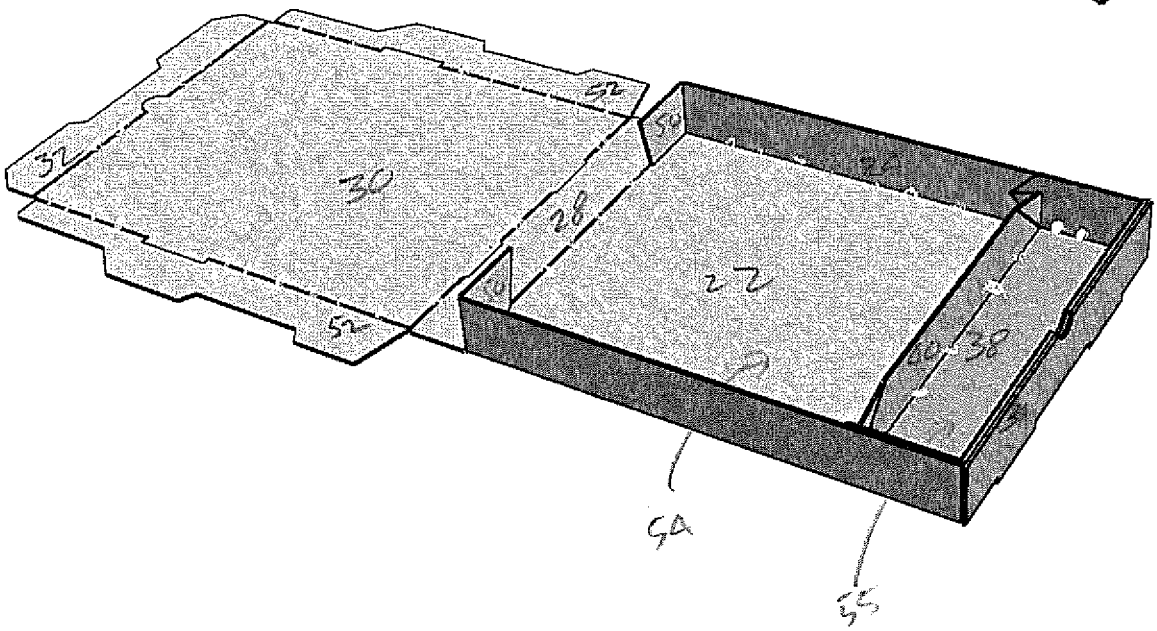
FIG. 6 is yet another perspective view of a partially assembled container according to the present invention.
Figure 7:
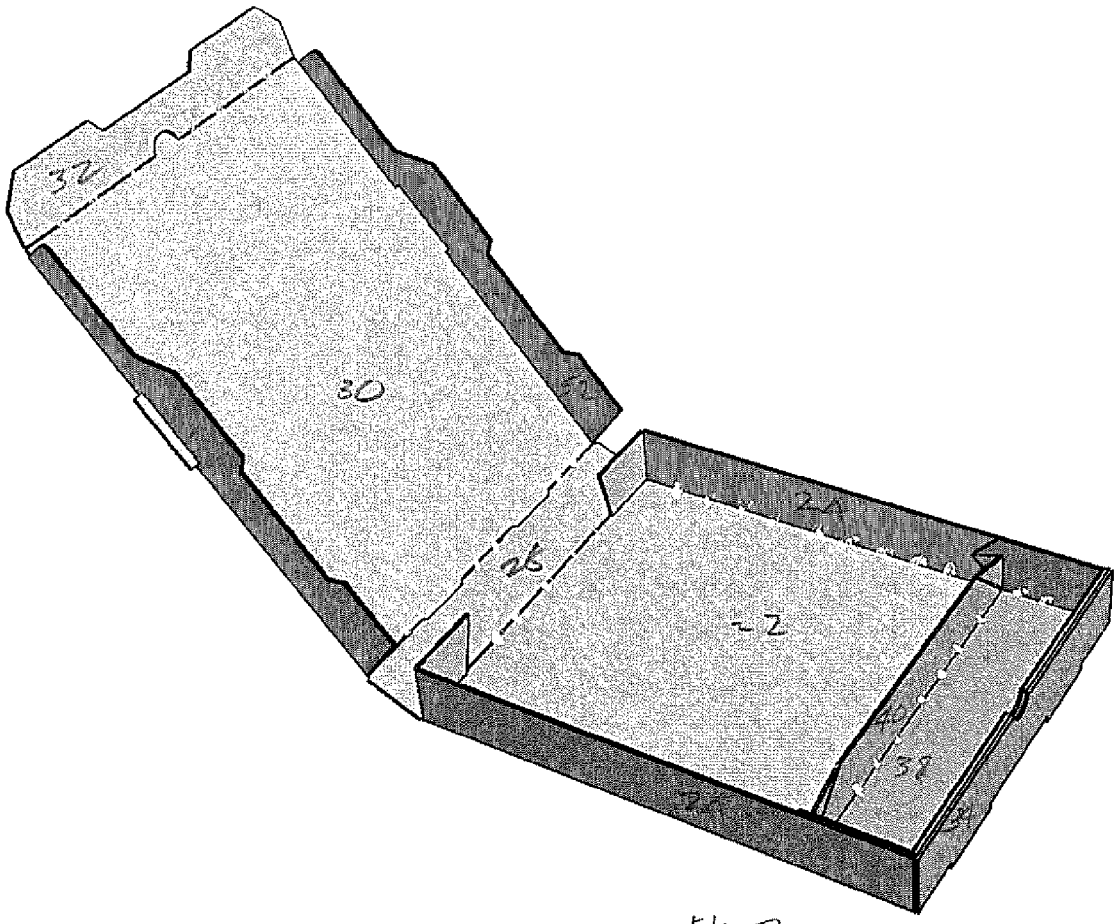
FIG. 7 is yet another perspective view of a partially assembled container according to the present invention; and, FIG. 8 is a perspective view of an assembled container according to the blank depicted in FIG. 1.
Figure 8:
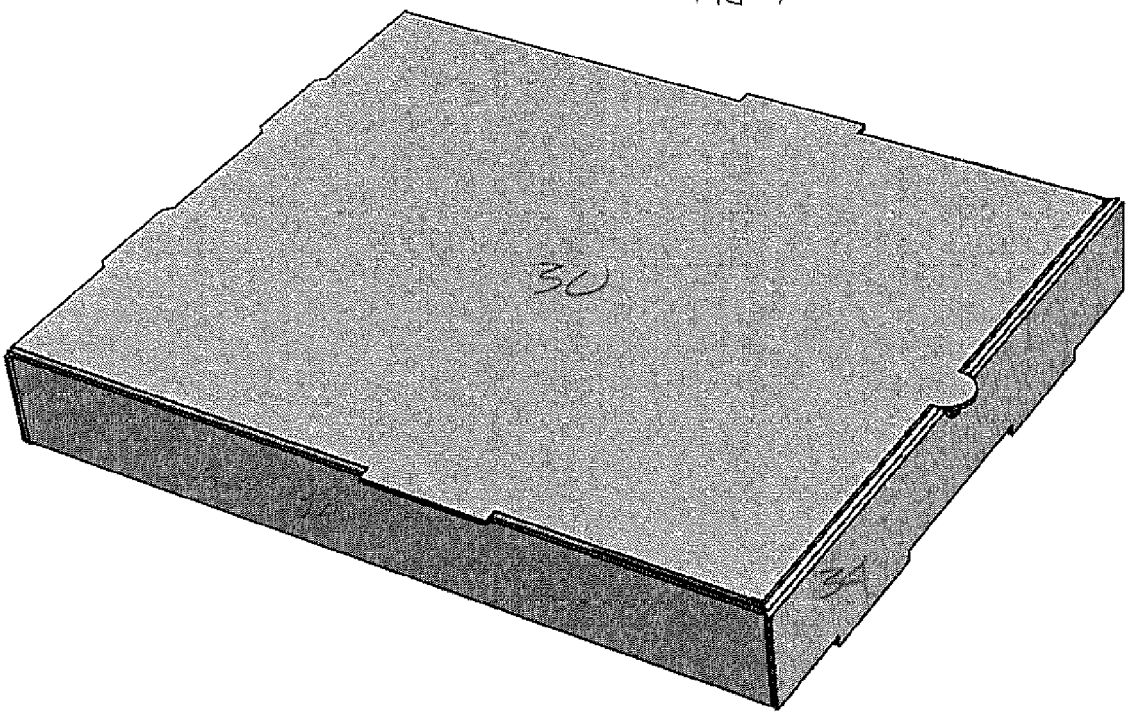

FIG. 1 depicts a blank 20 used to form the container 56. The blank 20 is preferably constructed from a single piece of formable material such as, without limitation, sheets of cellulose-based materials formed from cellulose materials such as wood pulp, straw, cotton, bagasse or the like. Cellulose-based materials used in this present invention come in many forms such as fiberboard, containerboard, corrugated containerboard and paperboard. The blank 20 is cut and scored, perforated or otherwise formed to include a plurality of panels that when assembled form container 56. In all FIGURES, like numbers indicate like parts. Additionally, cut lines are shown as solid lines, score lines as dashed lines, and lines of perforation as broken lines. For the purpose of further description herein, the downward direction is defined as the direction perpendicular to bottom panel 22 that corresponds to the outer surface of the bottom panel when the container has been erected. The upward direction is defined as the direction perpendicular to the bottom panel 22 that corresponds to the inner surface of the bottom panel when the container has been erected.

Referring now to FIG. 1, the blank 20 includes a bottom panel 22. Attached to the bottom panel 22 along fold lines 23 are opposed side panels 24. An outer front panel 34 is attached to the bottom panel 22 along fold line 21. Also, a back panel 28 is attached to the bottom panel 22, opposite the front panel 34, along fold line 25. A top panel 30 is attached to the back panel 28 opposite the bottom panel 22. The top panel 30 includes a top tab 32 hingedly connected with the top panel 30, opposite the back panel 28. Also, the top panel 30 includes opposed top side flaps 52 connected to the top panel 30 along fold lines 29. Likewise, side panels 24 have disposed at opposite ends rear flaps 50 and front flaps 42.

Hingedly connected to the outer front panel 34 along a fold line or pair of spaced fold lines 37 is an inner front panel 36. An inner bottom panel 38 is hingedly attached to the inner front panel 36 along a fold line 39. Likewise, a divider panel 40 is hingedly attached to inner bottom panel 38 along fold line 41. First and second comer panels, 46 and 48, respectively, are connected to inner side flaps 44 and the divider panel 40, respectively. Further, the first corner panel 46 is connected to the second comer panel 48, via a bellows fold line 47.

An aspect of the present invention is the nature of the attachment of the various panels and flaps. Specifically, in an embodiment, the fold lines are such that they do not have any open passage way between the relative panels. In this fashion, the container 56 is sift and leak proof when formed. By sift proof it is meant that the container 56 does not allow granular element to pass though the bottom panel 22 and surrounding panels. By leak proof it is meant, that the container 56 does not allow a liquid element to pass though the bottom panel 22 and surrounding panels. In another embodiment, the various fold lines may be formed such that they are not sift and/or leak proof.

FIGS. 2-8 illustrate the erection of the container 56 from the blank 20. Initially the back panel 28, front panel 34 and side panels 24 are folded upwards around fold lines 25, 21, 23 respectively. In folding the blank 20 in this manner, a first container area 54 is created.

The outer front panel 34, inner front panel 36, inner bottom panel 38, divider panel 40, inner side flaps 44, and first and second corner panels 46 and 48, respectively, may then be folded about their respective fold lines such that the inner front panel 36 and outer front panel 34 are juxtaposed one another and the inner bottom panel 38 is juxtaposed the bottom panel 22. Likewise, divider panel 40 will be vertically oriented creating a second container area 55.

Subsequently, the top tab 32, and top side flaps 52 may be folded around their respective fold lines and then the top panel 30 may be folded to close the container 56.

The top panel 30 is configured to completely cover the entire rest of the container 56. In this manner, the top panel 30 serves as a sanitary barrier for products contained within the container (not shown). Further, the top panel 30, top tab 32, and top side flaps 52 serve to secure any objects placed in the first and/or second container area, 54 and 55, respectively.

The present invention may be used in a variety of manners. By way of non-limiting example, the container 56 may be used in the food industry. In an application items such as pizza, chicken wings or nuggets, dipping breads, French fries, or onion rings (not shown) may be placed in the first container area 54, while other items (not shown) may be stored in the second container area 55. By way of further non-limiting example, the present invention is suitable for use in the arts and crafts industry. In this manner, brushes or figurines (not shown) or the like may be held in the first container area 54 while, paints (not shown) or other such items are supported in the second container area 55. Those skilled in the art will appreciate that the present invention is suitable for many other uses as well.

Any variety of additional elements may be included, such as, without limitation, vents, specialized liners or grease barriers, etc., without departing from the spirit and scope of the present invention. Similarly, rounding or otherwise trimming the various panels is considered within the scope of the instant invention.

While various embodiments of the invention has been illustrated and described, as noted above, many changes can be made without departing from the spirit and scope of the invention. Accordingly, the scope of the invention should be determined entirely by reference to the claims that follow.

What is claimed is:

1. A container comprising a bottom panel;

an outer front panel connected with the bottom panel;

a back panel connected with the bottom panel, opposite the front panel;

the back panel having an upper edge opposite the bottom panel;

a top panel connected to the upper edge of the back panel;

opposed side panels connected wit the bottom panel, interposed between the front panel and the back panel;

a front flap connected solely with one of the side panels, said front flap being juxtaposed the outer front panel;

an inner front panel connected with the outer front panel, said inner front panel being juxtaposed the front flap;

an inner bottom panel, connected with the inner front panel, said inner bottom panel being juxtaposed the bottom panel;

a divider panel connected with the inner bottom panel, said divider panel lying substantially perpendicular to the bottom panel and the inner bottom panel; and opposed inner side panels connected with the inner bottom panel, interposed between the inner front panel and the divider panel;

each of the opposed inner side panels being connected to the divider panel by a pair of triangular corner panels which are connected to each other by a single fold line to form a bellows fold between each inner side panel and the divider panel.

2. The container of claim 1, wherein the single sheet of foldable material is formed from a cellulose based material.

3. The container of claim 2, wherein the cellulose based material is formed from at least one of a wood pulp, straw, cotton, and bagasse.

4. The container of claim 2, wherein the cellulose based material is in the form of at least one of a fiberboard, containerboard, corrugated containerboard and paperboard.

5. A container blank comprising a single sheet of material divided by first, second third, fourth, fifth, sixth and seventh transverse fold lines into a top tab, a top panel, a back panel, a bottom panel, a front panel, an inner front panel, and inner bottom panel, and a divider panel;

a longitudinal fold line on each side of the top panel connecting top side flaps to each side of the top panel;

a longitudinal fold line on each side of the bottom panel connecting side panels to each side the bottom panel;

an eighth transverse fold line on the front edge of one of the side panels, the eighth transverse fold line being substantially aligned with the fourth transverse fold line, the eighth transverse fold line connecting a first front flap to the one side panel, the alignment of the eighth transverse fold line allowing the front flap to fold inwardly and be juxtaposed to the inner face of the front panel in the erect container;

a ninth transverse fold line on the front edge of the other side panel, the ninth transverse fold line being aligned with the eight transverse fold line, the ninth transverse fold line connecting a second front flap to the other side panel;

a longitudinal score line on each side of the inner bottom panel connecting inner side panels to each side of the inner bottom panel;

each of the inner bottom panels being connected to the divider panel by a pair of triangular corner panels, the corner panels being connected to each other by a single fold line.

* * * * *